US006375225B1

(12) United States Patent
Lapsker

(10) Patent No.: US 6,375,225 B1
(45) Date of Patent: Apr. 23, 2002

(54) COMBINATION SAMPLE DISPENSER AND ORDER FORM DEVICE

(75) Inventor: Joshua Lapsker, Toronto (CA)

(73) Assignee: Promex Medical, Inc., Hasbrouck Heights, NJ (US)

( * ) Notice: Subject to any disclaimer, the term of this patent is extended or adjusted under 35 U.S.C. 154(b) by 0 days.

(21) Appl. No.: 09/205,843

(22) Filed: Dec. 4, 1998

Related U.S. Application Data

(63) Continuation-in-part of application No. 08/687,828, filed on Jul. 26, 1996, now Pat. No. 5,908,208, which is a continuation of application No. 08/234,056, filed on Apr. 28, 1994, now abandoned.

(51) Int. Cl.[7] ..... B42D 15/00

(52) U.S. Cl. ..... 283/56; 283/72; 283/900; 206/528; 206/529; 206/534; 206/534.1; 206/534.2; 206/538; 206/543

(58) Field of Search ..... 283/56, 900, 72; 206/543, 528, 529, 534.1, 534.2, 538, 534

(56) References Cited

U.S. PATENT DOCUMENTS 3,621,992 A * 11/1971 Osborne ..... 206/56
5,755,462 A * 5/1998 Lupi ..... 283/56
5,803,499 A * 9/1998 Tung et al. ..... 283/56
D400,433 S 11/1998 Lupi
5,908,208 A * 6/1999 Lapsker ..... 283/56

* cited by examiner

*Primary Examiner*—A. L. Wellington
*Assistant Examiner*—Mark Henderson
(74) *Attorney, Agent, or Firm*—Klauber & Jackson

(57) ABSTRACT

The invention relates a combined sample dispenser and order form comprising a backing sheet that may be prepared from cardboard and a generally planar retaining member, such as a clear plastic sheet, attached to the backing sheet along at least a portion thereof. The retaining member or plastic sheet defines a distention or pocket along a portion of its broad surface, that may contain samples of the product being dispensed, such as sample medications provided to physicians by pharmaceutical manufacturers. The invention is also useful for the sale of certain consumable items, including hardware, where the order form may be used by the consumer to directly request additional quantities of the product.

17 Claims, 10 Drawing Sheets

COMBINATION SAMPLE DISPENSER AND ORDER FORM DEVICE

RELATED APPLICATIONS

The present application is a continuation-in-part of copending U.S. Ser. No. 08/687,828, filed Jul. 26,1996 which is a continuation of U.S. application Ser. No. 08/234,056 filed on Apr. 28, 1994, now abandoned now U.S. Pat. No. 5,908,208.

FIELD OF INVENTION

The present invention relates generally to sample containers/dispenser and particularly to a prescription sample card for simultaneously providing a sample of an article, such as a pill, and a prescription or order form for additional quantities of the item.

BACKGROUND OF THE INVENTION

It has been the practice of pharmaceutical manufacturers to provide physicians with sample medications to be dispensed to patients. In addition, the physician may be provided with multi-sheet pads of paper or multi-sheet prescription pads preprinted with the name of a medication to be prescribed. These practices allow a physician to dispense a sample of a medication before a patient can obtain a full prescription of the medication, and to write a specific prescription conveniently.

DESCRIPTION OF PRIOR ART

A number of pharmaceutical dispensing systems have appeared in the prior art. These systems, however, fail to provide an economical as well as convenient means of dispensing prescription medication with an attached preprinted prescription sheet. For example, U.S. Pat. No. 2,652,149 to O'Meara, issued Sep. 15, 1953, which provides both a writing surface and packaging for tablets or capsules, relates to a combination package memo-pad. Holes in the pad of paper provide pockets for the tablets or capsules, which can be sealed in a flanged envelope. The envelope containing the medicinal tablets or capsules can be inserted between the sheets of paper so as to be displayed through the holes. A physician can remove one or more tablets found in the sealed flanged envelope to give a patient, and may then may write directions for the patient on the uppermost sheet of paper and remove it from the pad. The remaining sheets of paper and unused medicine are retained by the physician for later use.

U.S. Pat. No. 2,877,893 to Volekening et al., issued Mar. 17, 1959, relates to a package with a removable information sheet, e.g., a sheet of printed matter pertaining to the contents of the package. The package consists of a commodity-containing section and a pocket section. The pocket section can contain, for example, an information sheet, label, direction sheet, or a booklet pertaining to the contents of the commodity-containing section. A physician would give the commodity section to a patient and retain the information for his own use.

U.S. Pat. No. 3,47,358 to Meyers, issued Oct. 17, 1967, and U.S. Pat. No. 3,621,992 to Osborne et al., issued Nov. 23, 1971, relate to drug distribution devices for use by nurses in a hospital or by a pharmacist in which information regarding distribution of medication or preloaded syringes is controlled by recordation. U.S. Pat. No. 3,189,053 to Stagnitto et al., issued February 19, 1980, relates to a medicinal dispenser kit in which a pharmacist places a prescribed amount of a given medicine, into a sealable envelope. U.S. Pat. No. 5,048,820 to Mangini et al., issued Sep. 17, 1991, relates to a tray of containers of drugs with a package insert. Each container has a multipart flag label which consists of self-adhesive stickers to be used for labeling, inventory. billing, etc.

From the above, it can be seen that the prior art does not provide a convenient and economical means for dispensing sample medication attached to a preprinted prescription sheet so as to benefit physician and patient alike. Accordingly, it is toward the fulfillment of this need by the provision of such a combined product that the present invention is directed.

SUMMARY OF THE INVENTION

In accordance with the invention, a combination sample dispensing and ordering device is prepared which may in one embodiment be a prescription sample card. The sample dispensing and ordering device includes a backing member, a planar retaining member and an ordering assembly. The planar retaining member, which is attached to the backing member, defines a distention along a portion of its broad surface to contain a sample or samples of an article. The ordering assembly is disposed between the backing member and the retaining member.

More particularly, the device of the invention may be prepared as a prescription medication sample dispenser and prescription assembly. The prescription assembly includes a preprinted prescription form for the medication, and may include additional printed information about the medication.

In its use as a prescription sampler and pad, the device of the invention provides a physician with a convenient system for dispensing a sample of prescription medication to a patient, as well as a prescription for the same medication. In this aspect, the device of the invention comprises a backing member, for example cardboard, onto which a retaining member, for example a clear plastic sheet defining a distention such as a blister bubble, is secured. The distention or blister bubble which may contain samples of medication, may be backed with a pierceable material, such as foil or paper, so as to protect and facilitate removal of the sample medication. If a pierceable material is not used, the backing for the blister bubble is the backing member. A first prescription sheet, which may be accompanied by a second sheet containing information, may be removably attached to the backing member. The prescription sheet, which may be personalized for an individual physician, is used to write a prescription for an additional quantity for the sample medication.

In a preferred embodiment of the present invention, the sample dispenser and order device comprises a backing member having a front face and a rear face. The retaining member is secured to the front face and which contains the sample article such as a prescription medicine and also retains the ordering assembly such as the prescription sheet or ordering information to the front side of the backing member. A fold line is formed in the sample dispenser and order device intermediate the sample of the article contained within a distention in the retaining member and the prescription or ordering information such that the backing member is folded along the fold line that extends laterally fully across the sample dispenser and order device. As such the backing material and the retaining member are folded backwardly about the fold line such that the overall sample dispenser and order device dispenser is reduced in overall dimensions for convenience of storage and presentation and so that the sample article becomes externally located at the rear of the overall dispenser package. In this manner, the overall dispenser is more convenient for the user to store in a suitable cabinet or in a smaller tray yet the dispenser is fitted conveniently within the cabinet and/or tray for ease of dispensing and presentation.

Accordingly, in this embodiment, the sample dispenser can be stored in a more convenient location for the physician and can fit easily into a container that can be within the facilities of the physician at close hand for dispensing to the patient.

Among the advantages of the present invention, each sample of medication can be provided with a preprinted prescription form for that particular sample medication. The physician who utilizes the present invention does not have to search a cabinet filled with sample medications and then search again for a specific prescription pad. The physician needs only to fill out the prescription sheet provided with the sample to allow a patient to obtain an additional quantity of the attached sample medication. Another advantage to the present invention is that it allows the patient to commence treatment immediately, rather than delaying treatment until the prescription can be filled.

Analogously, the invention provides for attachment of an order form, such as a postage-paid order form, or similar form. An individual to whom a sample of a non-prescription article, e.g., medication or device, is given can use the order form to obtain an additional quantity of the article. Thus, the present invention advantageously simultaneously provides a sample of an article with means for obtaining an additional quantity of the article.

Accordingly, it is an object of the invention to provide a device which simultaneously supplies a sample of an article and means for obtaining more of the article.

More particularly, it is an object of the invention to provide a sample of a prescription medication and a preprinted prescription form for prescribing such a medication.

It is a further object of the invention to provide a device that simultaneously provides a sample of a non-prescription conveniently packaged with an order form for obtaining more of the article.

It is a still further object to provide a device that is conveniently sized so as to be storable in multiple quantities in a container for ease of dispensing by the user, such as a physician.

Other objects and advantages will become apparent to those skilled in the art from the consideration of the ensuing description which proceeds with reference to the following illustration drawings.

DETAILED DESCRIPTION OF THE INVENTION

Figure 1:
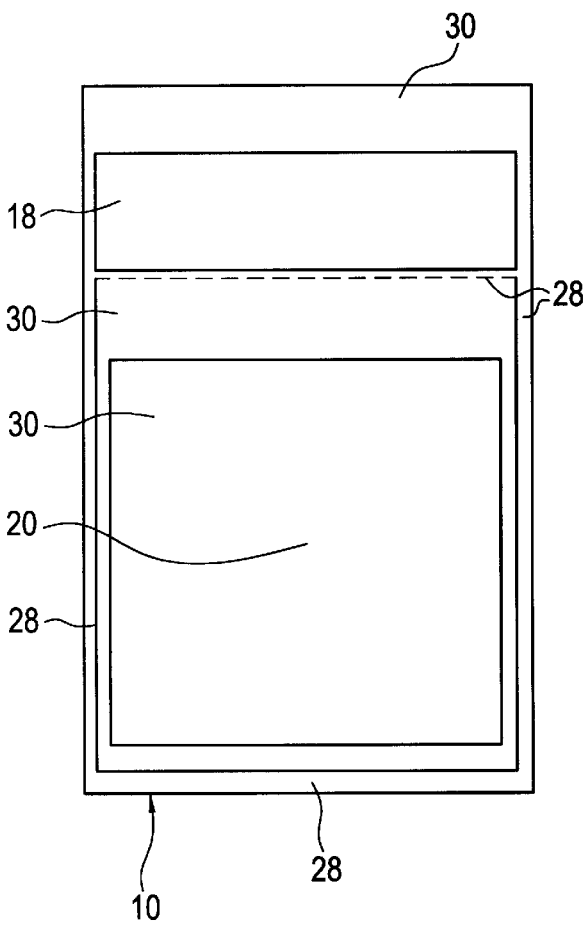
FIG. 1 is a plan view of a combination sample dispensing and ordering device in accordance with an embodiment of the invention.

Referring now to FIG. 1, a combined sample dispenser and order device 10 is illustrated. Device 10 comprises a backing member 12 and a planar retaining member 14 attached thereto. In turn, retaining member 14 defines a distention 16 to hold product samples. Backing member 12 can be any firm material which resists bending or flexing, such as stiff plastic or cardboard, or a composite, or other suitable material. In a specific embodiment, backing member 12 is made of cardboard. Backing member 12 has a front face 12*a* as well as a back face 12*b*.

The planar retaining member 14 can be made of any material in which a distention or cavity 16 can be formed. In a specific aspect, the retaining member is a moldable plastic material. In a preferred embodiment, the material is clear or transparent to permit the sample prescription medication to be viewed. Retaining member 14 is secured to the front face of backing member 12 along at least one edge. Any means can be used to secure the retaining member to the backing member, for example, by stapling, clipping, sonic welds, or adhesive. In a preferred embodiment, the planar retaining member is attached to the back member along its four side edges. In another embodiment, the planar retaining member is attached to the backing member alone the top edge in order to permit lifting and to provide access to the ordering assembly.

As noted above, retaining member 14 has at least one article containing distention 16. such as a blister bubble. Distention 16 may be modified to accommodate different sizes and quantities of sample product or article 18. The remaining portion of the planar retaining member extends over the sample prescription card.

A seal of pierceable material, not shown, such as foil or paper may cover the back of the distension to enhance shelf life or facilitate removal of the article. In one embodiment, the backing member may define a portal covered by such prescribed material. The distention is superimposed over such a portal. Alternatively, the retaining member may be attached on one side, defining a hinge, whereby lifting the retaining member provides access to the article by piercing the pierceable material.

In a preferred embodiment, there is an excised portion 20 of the same dimensions and locations as the ordering assembly. This excised portion permits access to the ordering assembly for inscription and removal.

Figure 3:
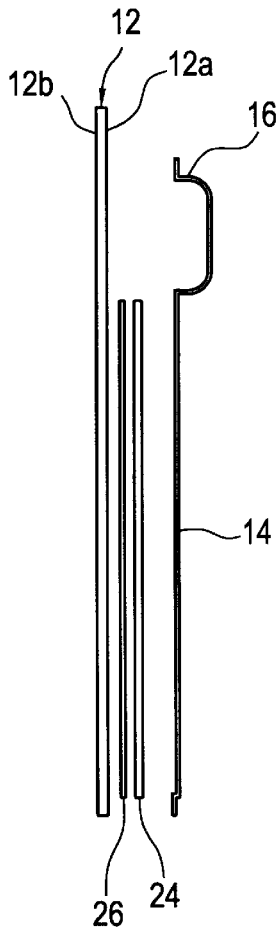
FIG. 3 is an exploded view of the device of FIG. 2.
Figure 4:
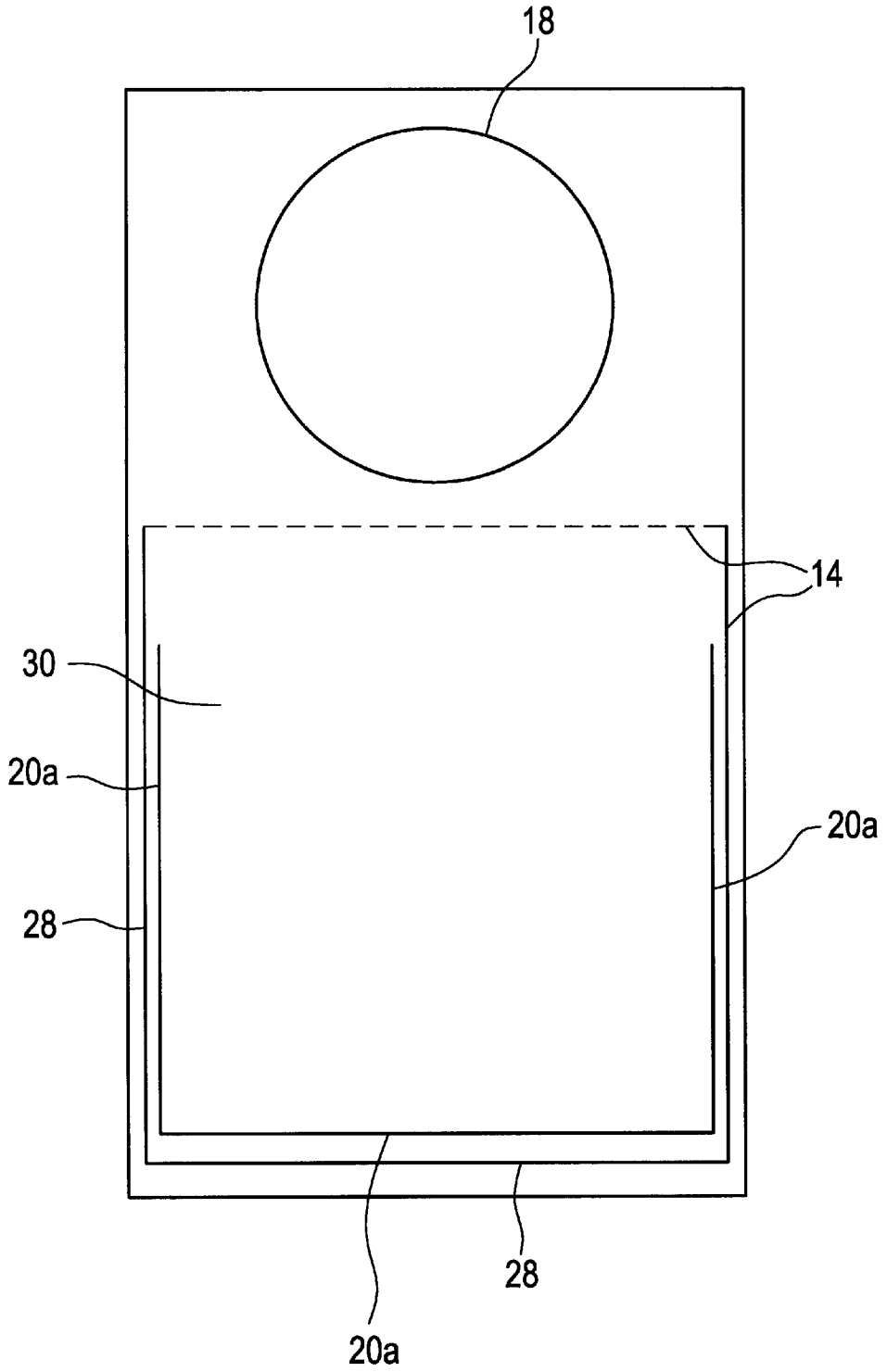
FIG. 4 is a plan view of a combination sample dispensing and ordering device in accordance with an alternate embodiment of the invention.
Figure 5:
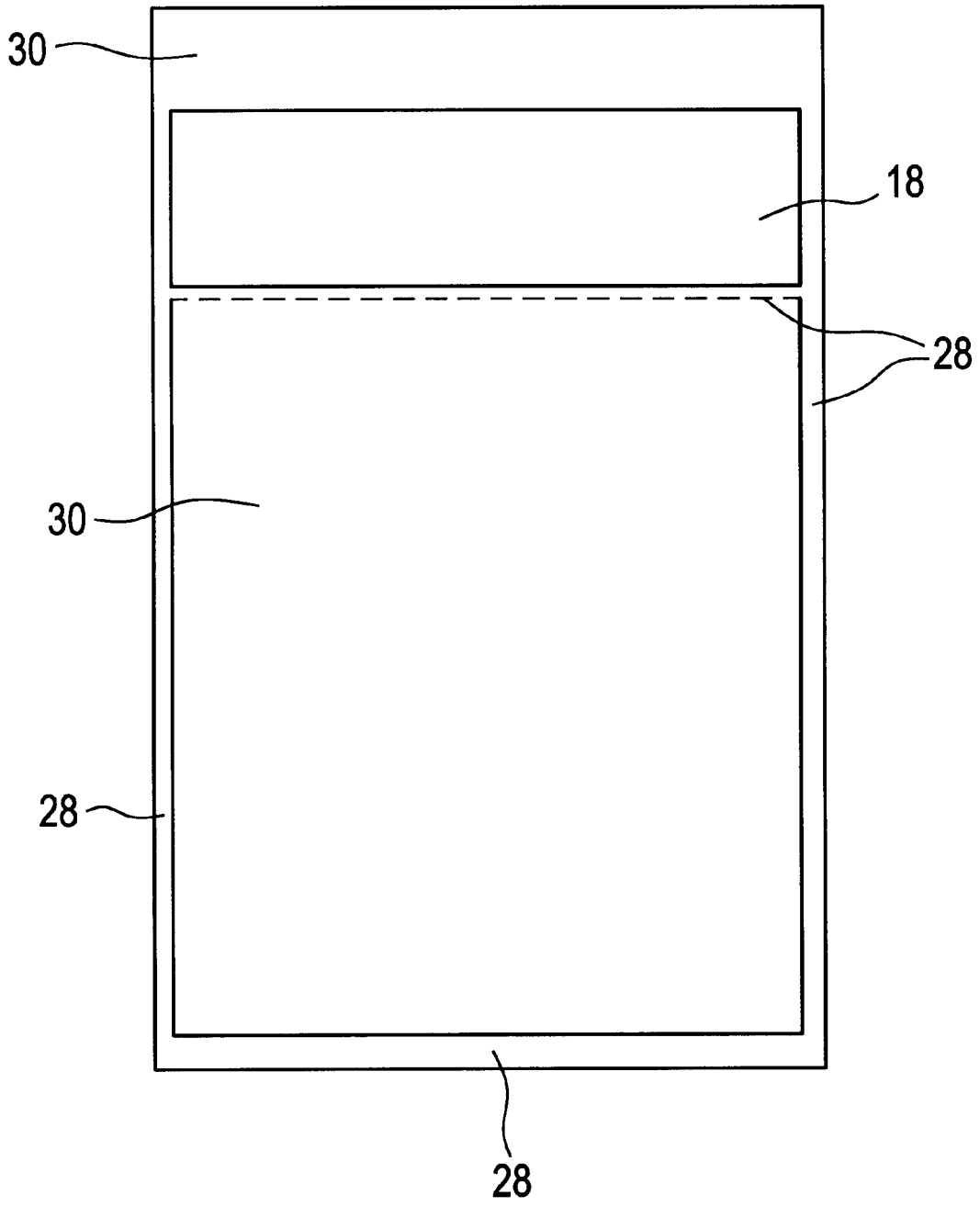
FIG. 5 is a plan view of a combination sample dispensing and ordering device in accordance with a further alternate embodiment of the invention.

In another embodiment shown in FIG. 3, the extending portion of the planar retaining member can be lifted to provide access to the ordering assembly.

Figure 2:
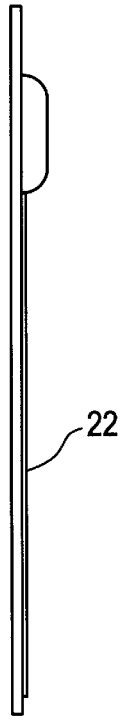
FIG. 2 is a side view of the device of FIG. 1.

Alternatively modification provides that the extending portion is cut along three sides 20*a* corresponding to the dimensions and locations of the ordering assembly to form a flap which is lifted to access the prescription assembly, as shown in FIG. 2.

The preprinted ordering assembly 22 is comprised of a single order form 24, and may include one or more sheets containing additional information 26 concerning the article. The ordering assembly can be secured to the backing member along one or more edges in any suitable manner, for example, staple, clip or adhesive, so as to permit lifting and removal of the ordering assembly. Additionally, the ordering assembly may be perforated, scored or weakened in some manner, 28, in order to facilitate removal from the sample prescription card.

In another embodiment the ordering assembly may be a portion of the backing member, which may itself contain a preprinted order or prescription form. Accordingly, the backing member can be detachable from the device, so that the completed order form can be used to obtain an additional quantity of the article. In a further embodiment, the retaining member can also be detachable.

Figure 6:
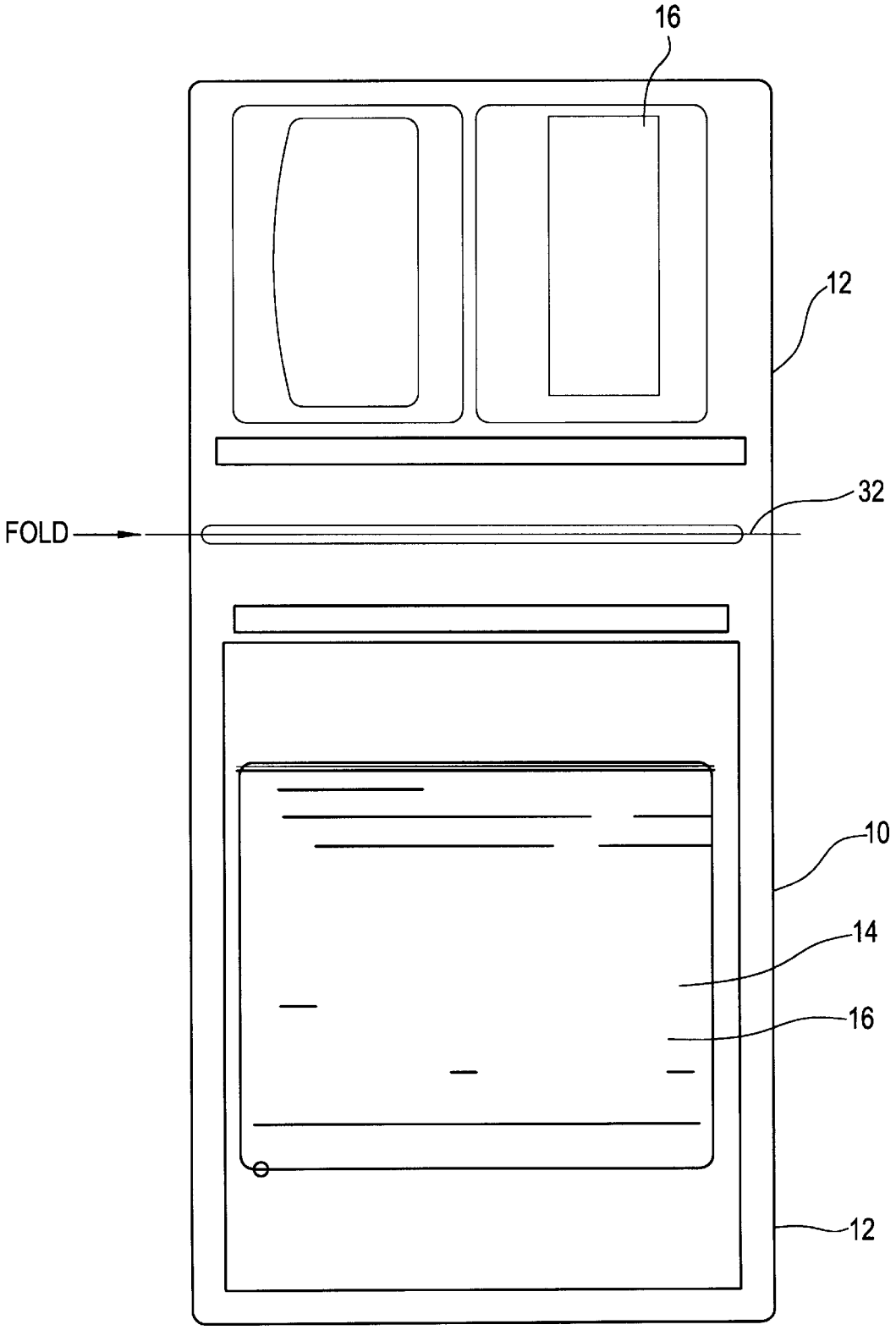
FIG. 6 is a plan view of the folded version embodiment of the invention.

As a still further embodiment, the combined dispenser and order device 10 is shown in plan view in FIG. 6 as a folded version and which enables the convenient storage and presentation of the device. As shown in FIG. 6, the backing member 12. again can be any stiff cardboard or similar material and has a front face 12 and a back face 12*b*(not shown in FIG. 6). Again, the planar retaining member 14 is attached to the backing member 12 and has at least one distention 16 In the FIG. 6 embodiment, there are two such distentions 16, however, as will be seen, various number of distentions can be employed in carrying out the present invention. The ordering assembly 22 can comprise a prescription form as shown in the Figure and which can be covered by the retaining member 14. Alternatively, as will be seen, the retaining member 14 may be confined to a certain portion of the overall device 10 and the prescription form can be printed on a removable sheet on the front face 12*a* of the backing member 12.

Figure 6A:
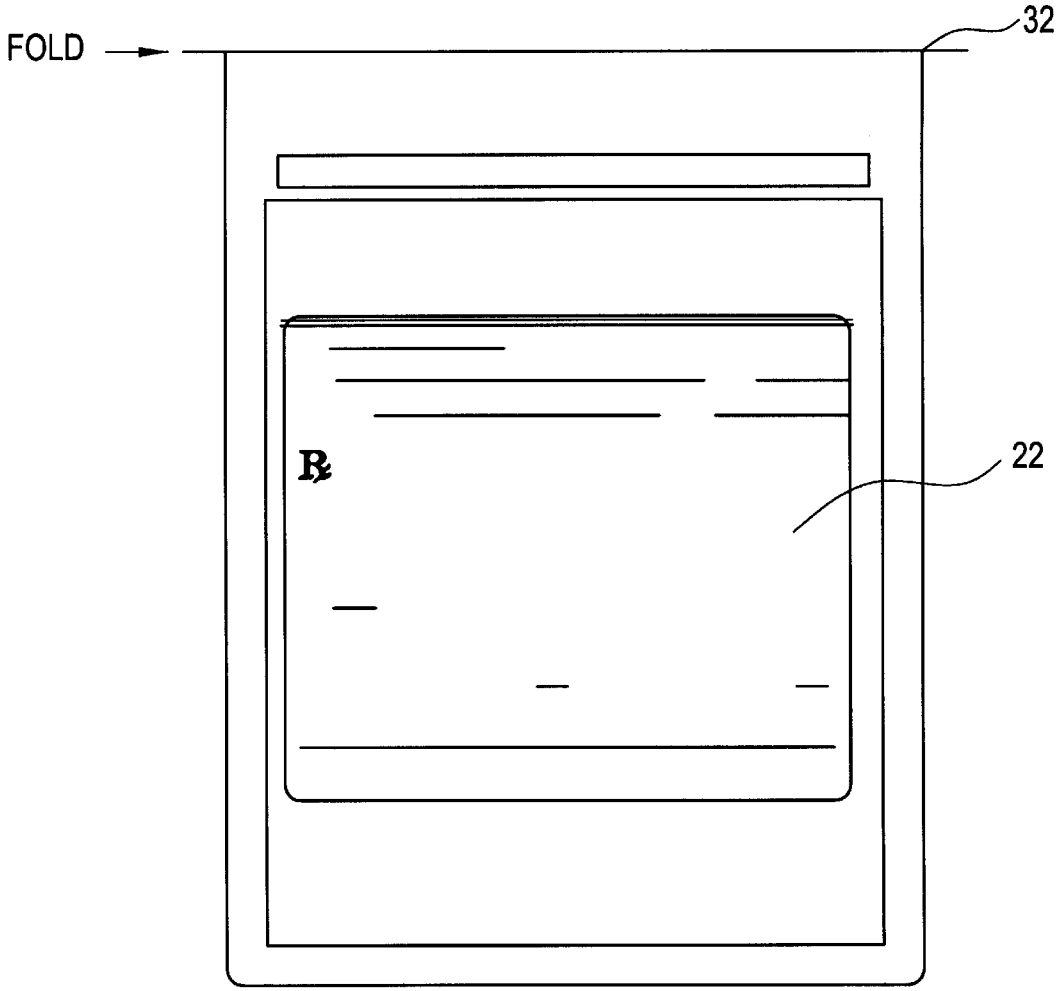
FIG. 6A is a front view of the device of FIG. 6 in its folded configuration.
Figure 6B:
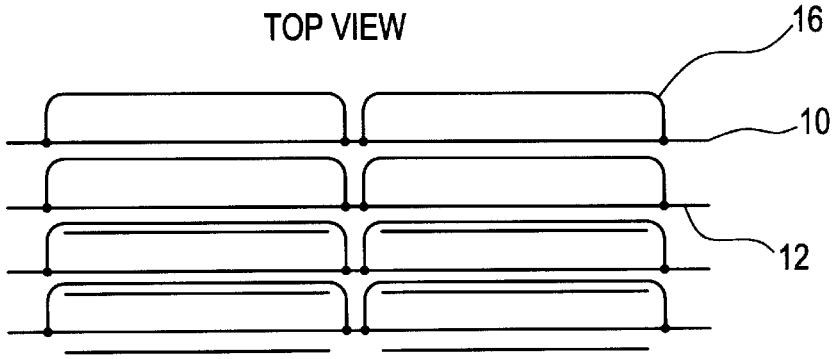
FIG. 6B is a top view of the device so FIG. 6 in its folded configuration.

In this embodiment a fold line 32 is formed in the device 10 by means such as scoring, or in some similar manner, weakening the material so that the sample dispenser and order device 10 can be folded at the fold line 32. The fold line 32 may alternatively be made by removing a portion of the material along the fold line 32 to create a weakened portion of the device 10 substantially entirely across the device 10. As shown, the fold line 32 extends laterally entirely across the sample dispenser and order device 10 and is located intermediate the location of the order assembly 24 on backing member 12 and the location of the sample product 18 contained within the distentions 16. Turning to FIG. 6A and 6B, there is shown the sample dispenser and order device 10 of FIG. 6 in its folded configuration and wherein the front face 12*a* of the sample dispenser and order device 10 locates the ordering assembly 22, such as the prescription or other material and the rear of the sample dispenser and order device 10 therein locates the distention 16 that contains the sample article 18 such as a prescription medicine.

As can readily be seen in FIG. 6B, by the folding procedure, the overall sample dispenser and order devices 10 can be readily stacked together in close proximity to each other, that is, the sample dispenser and order devices 10 can be layered together and take up relatively little space with a minimum of dead space therebetween. The ability to tightly stack multiples of the sample dispenser and order devices 10 is facilitated by the reduced dimensions of the perimeter, such that the devices 10 can be placed in a convenient tray or cabinet for use by the physician as will be later explained.

Figure 7:
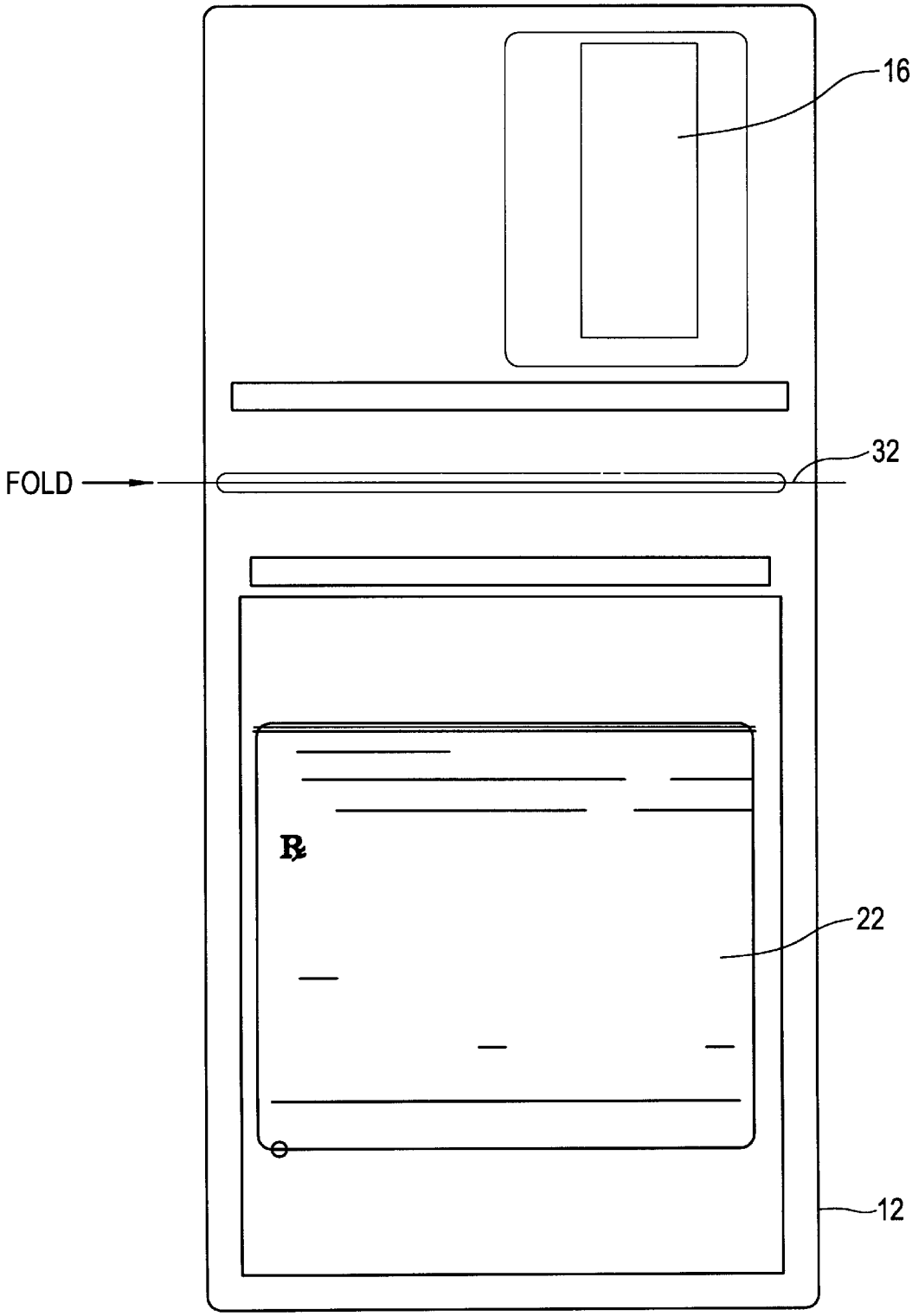
FIG. 7 is a plan view of a still further folded version embodiment of the present invention.
Figure 7C:
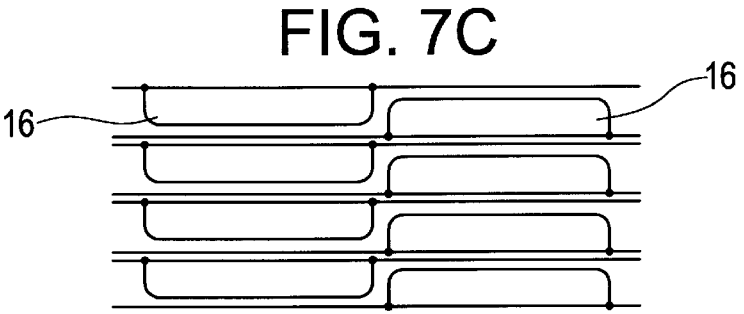
FIG. 7C is a top view of the device of FIG. 7 in its folded configuration.
Figure 7B:
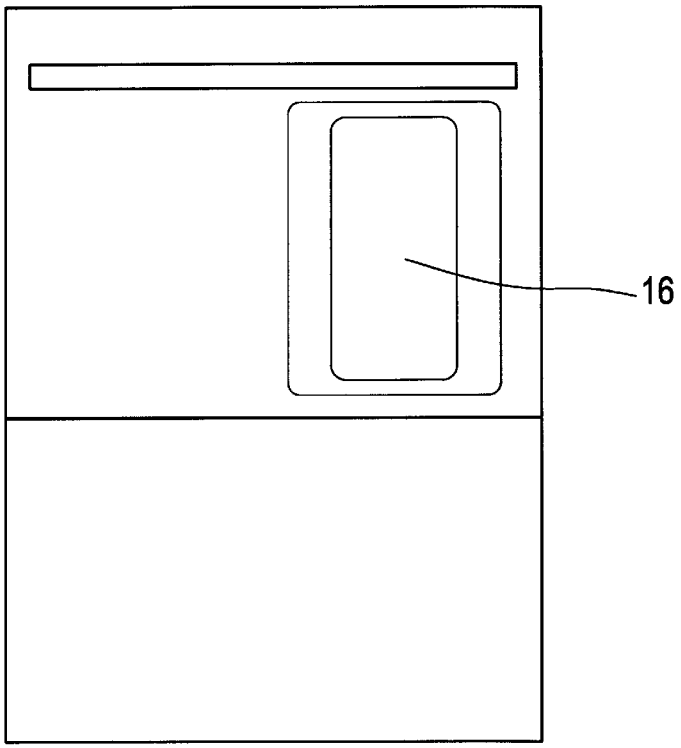
FIG. 7B is a rear view of the device of FIG. 7 in its folded configuration.
Figure 7A:
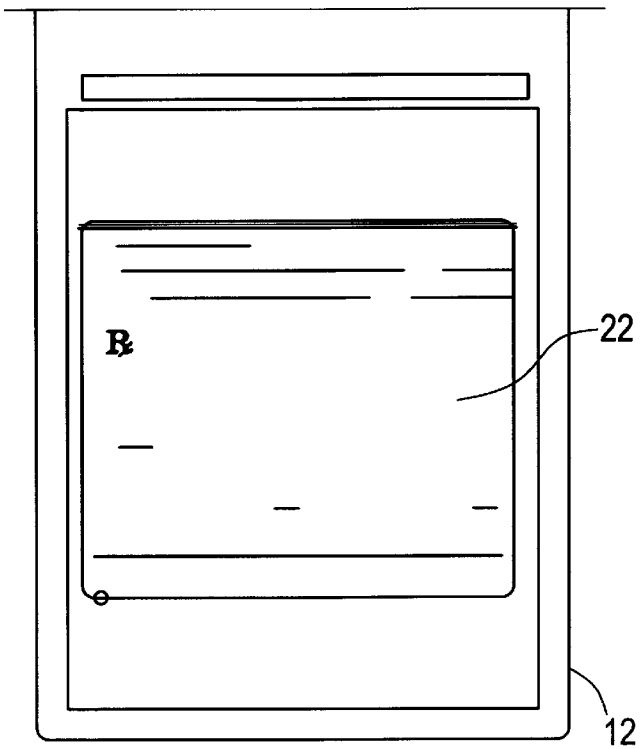
FIG. 7A is a front view of the device of FIG. 7 in its folded configuration.

Turning now to FIG. 7, there is shown a plan view of a still further embodiment of the foldable configuration wherein only one distention 16 is employed that contains the sample article and there is further shown in FIG. 7A, a front view showing the ordering assembly 22 as is convenient for the physician to access and note the indicia on the device 10 that enables the physician to identify the particular sample of article desired to be dispensed. In the rear view of FIG. 7B, there is shown the sample article contained within the distention 16 and, in this embodiment, the distention 16 is displaced with respect to the center line of the device 10 and is offset. By the use of the offset location of the sample article 18, the sample dispenser and order device 10 can be intermixed, front to back, as seen in FIG. 7C and are thus capable of being fitted together with a minimum of dead space to enable a multiple number of the devices 10 to be stacked together into a single container.

Figure 8:
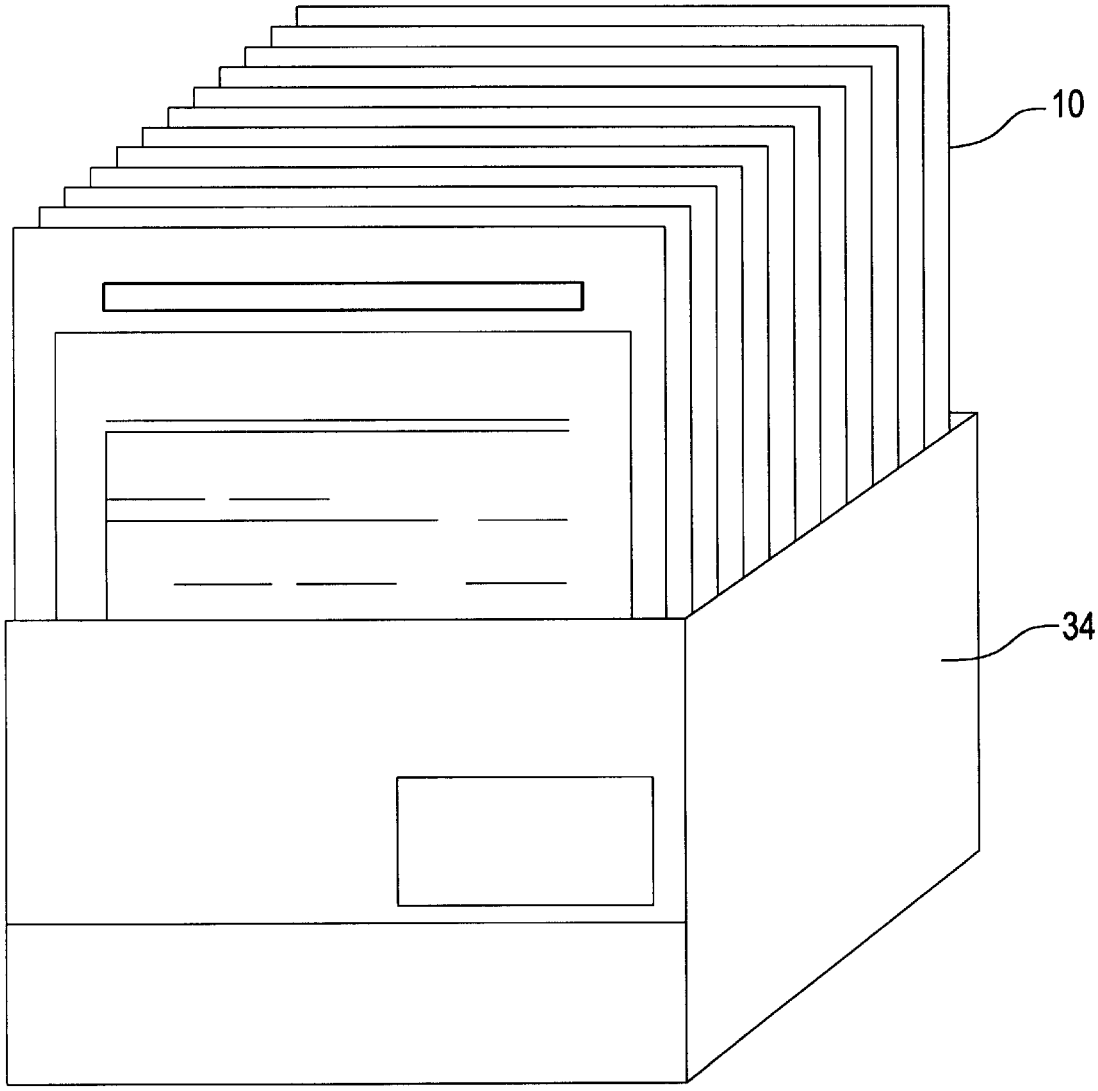
FIG. 8 is a isometric view of a container for displaying and holding a plurality of the devices in their folded configurations.

In FIG. 8, there is shown a perspective view of a typical container 34 that contains a plurality of the sample dispenser and order devices 10 of the folded configuration and, as can be seen, the reduced dimensions brought about by the folding procedure allows the container 34 to be relatively small and convenient to the physician and yet have a pleasing presentation to the physician. By the folding configuration, therefore, the container 34 can be of a relatively small size and yet, as explained with respect to the previous Figures, the positioning of the distention 16 containing the sample article such as a medicine, allows a considerable number of sample dispenser and order devices 10 to be fitted into a single container 34.

Figure 9:
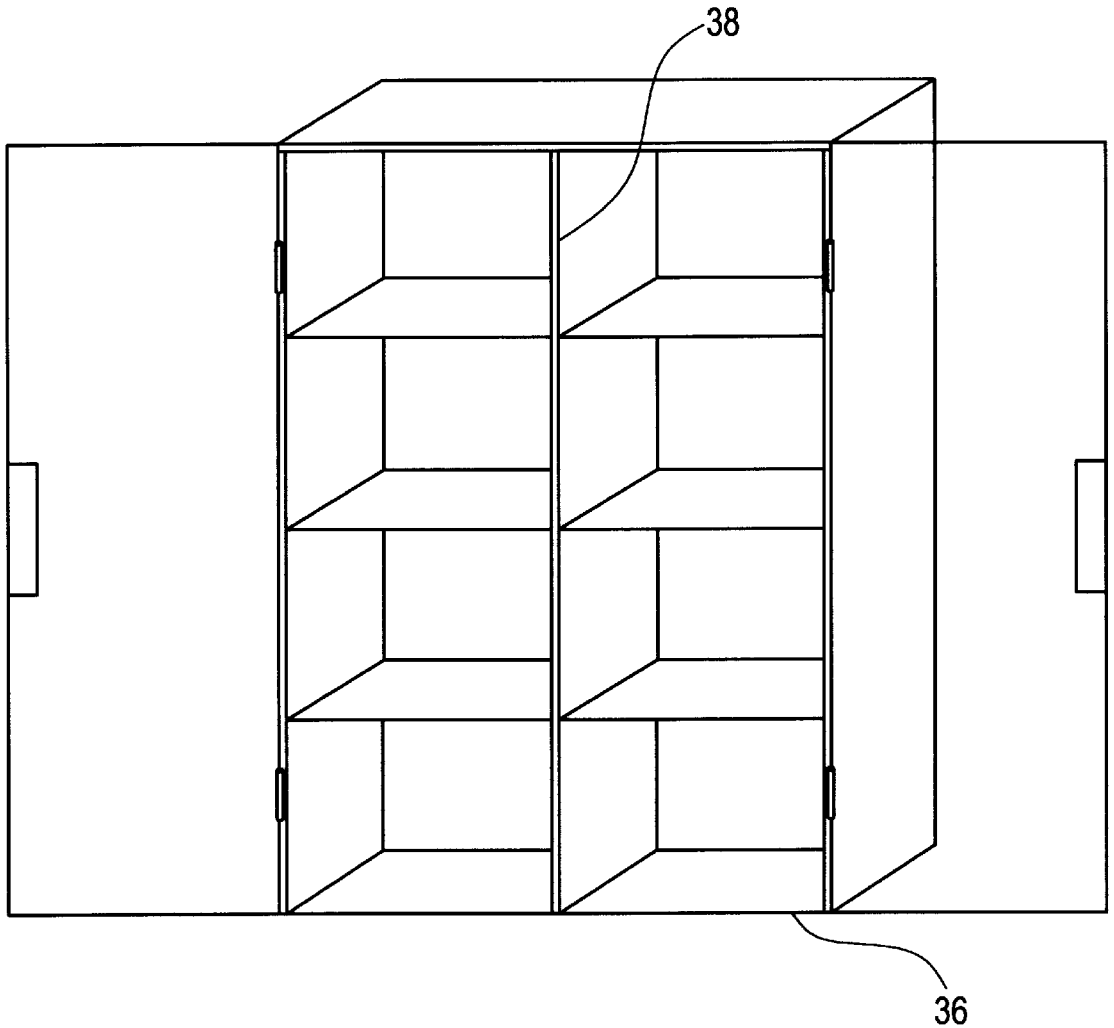
FIG. 9 is isometric view of a cabinet that can conveniently hold a plurality of the containers of FIG. 8.
Figure 10:
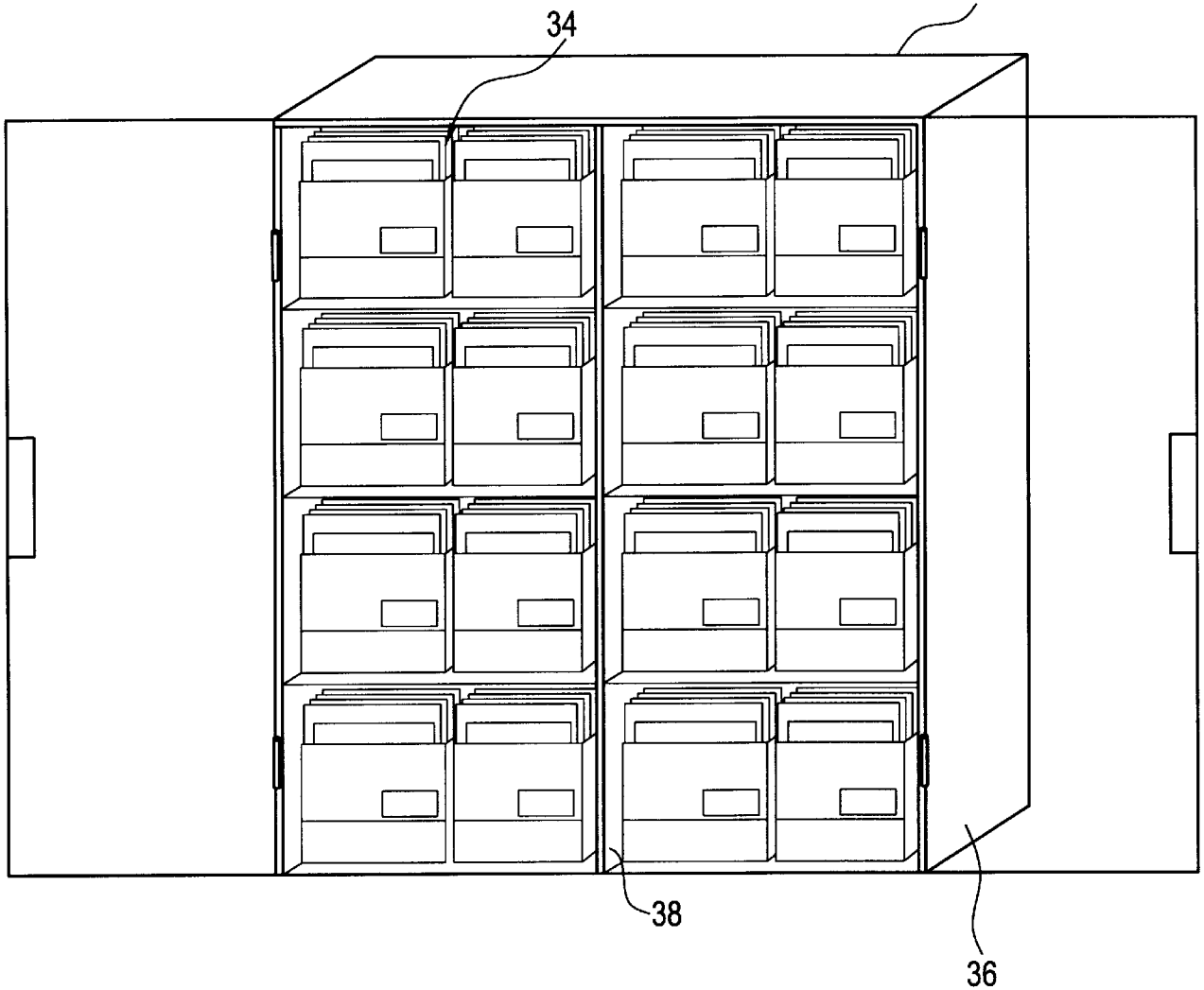
FIG. 10 is a isometric view of the cabinet of FIG. 9 that contains the plurality of containers of FIG. 8.

Turning now to FIG. 9, there is shown a perspective view of a sample cabinet 36 that can be used to contain the various containers, each having a plurality of sample dispensers 10 contained therein and the sample cabinet 36 can have a plurality of partitions 38 so as to allow each container to be placed into an individual compartment 40 for the convenience of refilling the containers by the physician. In FIG. 10, there is shown a perspective view of the sample cabinet 36 and which has been filled with the various containers 34 so that the overall sample prescription or other material can readily be available to he physician to store the prescription and to access the cabinet to distribute the prescription as desired.

As used herein, the term "ordering assembly" refers to an assembly that comprises an order form useful for obtaining an additional quantity of the sample article. In a preferred embodiment, the term "ordering form" refers to a prescription form. The order form preferably contains preprinted information, space for which is provided on the ordering form 30. In a preferred embodiment, a prescription form is preprinted with the name and dosage of the sample medication, the doctor's name, address, and Drug Enforcement Number, a space for the patient's name and address as well as spaces and boxes for the doctor to complete regarding the amount of the prescription and whether there are to be refills. The prescription form is prepared in preprinted form to follow all of the formats of the respective states in which the form may be distributed and used.

Alternatively, the order form can contain a preprinted postal or mailing address, and space for inscribing ordering information such as name and address, the amount being ordered, and perhaps a method of payment. The order form may be a post card with prepaid postage, or a form to be sent in a separate envelope.

The sample articles may be removed from the distension by removing the backing member. If a seal of pierceable material covers the back of the distension it must be peeled from the back of the planar retaining member or pierced, for example by cutting or piercing with a sharp object, to remove the article.

As noted above, a sample of any article can be provided in the device of the present invention. Preferably, the article is on the order of about 0.5 cm to about 10 cm in any dimension. Examples of such articles are pills, capsules and tablets of prescription or non-prescription medications. Small tubes of creams, lotions, and the like or small packages of cosmetics can also be provided. In a further aspect, the distention may contain devices such as a condom, cosmetic brush, razor blade, and the like.

In a further aspect the article may be a food or a food additive, such as a flavoring or color agent, as well as non-food articles, such as, for example, hardware fittings that may desirably accompany O.E.M. equipment, to facilitate the reordering of fungible, consumable parts.

The present invention is not to be limited in scope by the specific examples disclosed herein. Indeed, various modifications of the invention in addition to those described herein will be apparent to one of skill in the art from the foregoing description and accompanying figures. Such modifications are intended to fall within the scope of the appended claims.

What is claimed is:

1. A combination sample dispensing and ordering device comprising:

a backing member having a front face and a back face;

a retaining member attached to the front face of the backing member, which retaining member defines a broad surface along a portion thereof and a distention to contain an article and in which the retaining member defines an opening to access the ordering assembly;

a preprinted ordering assembly contained within said combination device comprising an order form disposed between the backing member and the retaining member, a portion of said retaining member proximate to said distention being affixed to said front face to prevent inadvertent release of said article from said distention; and a fold line formed in said combination device, said fold line extending at least substantially laterally across said combination device and located intermediate said distention and said preprinted ordering assembly whereby said front surface having the article contained within said distention is folded over rearwardly with respect to said preprinted ordering assembly such that the back face is folded inwardly wherein said distension faces inwardly of said folded combination device and said front face having said retaining member enclosing the preprinted ordering assembly faces outwardly of said folded combination device.

2. The device according to claim 1 in which the backing member is cardboard.

3. The device according to claim 1 in which the retaining member is a clear plastic sheet.

4. The device according to claim 1 in which the distention is a blister bubble.

5. The device according to claim 1 in which the distention is backed with a pierceable material.

6. The device according to claim 1 in which the article is a sample medication.

7. The device according to claim 1 in which the ordering assembly is removably attached to the backing member.

8. The device according to claim 1 in which the ordering assembly further comprises an information sheet.

9. The device according to claim 1 in which the order form is a preprinted prescription form for a prescription of the sample article.

10. The device according to claim 1 in which the order form contains a mailing address.

11. The device according to claim 7 in which the ordering assembly is perforated scored or weakened so as to permit removal.

12. The device according to claim 8 in which the information sheet is perforated, scored or weakened so as to permit removal.

13. The device according to claim 9 in which the prescription sheet is personalized.

14. A combination sample dispensing and ordering device for a controlled pharmaceutical product to be distributed to patients only upon the direction of a licensed healthcare provider, said device consisting essentially of:

a backing member having a front face an a rear face:

a retaining member attached to the front face of said backing member, which retaining member defines a cavity to contain said controlled pharmaceutical product;

an official prescription form removably held on the front face of said backing member, said prescription form compliant with governmental regulations for prescribing said controlled pharmaceutical product by physicians for dispensing by pharmacists; and a weakened fold line extending at least substantially laterally across said combination device intermediate said cavity containing said controlled pharmaceutical product and said official prescription form to enable said front face having the cavity containing said controlled pharmaceutical product to be folded rearwardly to a position abutting the rear face of said backing member with said front face having said cavity containing said controlled pharmaceutical product facing rearwardly with said official prescription form held on the front face of said backing member facing frontwardly.

15. A combination sample dispensing and ordering device comprising:

a backing member having a front face and a back face;

a retaining member attached to the front face of the backing member, which retaining member defines a broad surface along a portion thereof and a distention affixed to the front face of the backing member to contain an article, a preprinted ordering assembly contained within said combination device comprising an order form disposed between the backing member and the retaining member, a portion of said retaining member proximate to said distention being affixed to said front face to prevent inadvertent release of said article from said distention, said retaining member further having an opening comprising an excised portion for accessing the ordering assembly; and a fold line formed in said combination device, said fold line extending at least substantially laterally across said combination device and located intermediate said distention and said preprinted ordering assembly whereby said front surface having the article contained within said distention is folded over rearwardly with respect to said preprinted ordering assembly such that said back face is folded inwardly wherein said distension faces inwardly of said combination device and said front surface having said retaining member enclosing the preprinted ordering assembly faces outwardly of said folded combination device.

16. A combination sample dispensing and ordering device comprising:

a backing member having a front face and a back face;

a retaining member attached to the front face of the backing member, which retaining member defines a broad surface along a portion thereof and a distention affixed to the front face of the backing member to contain an article;

a preprinted ordering assembly contained within said combination device comprising an preprinted ordering assembly disposed between the backing member and the retaining member, a portion of said retaining member proximate to said distention being affixed to said front face to prevent inadvertent release of said article from said distention, said retaining member further having an opening cut on three sides to permit lifting of said retaining member to access said preprinted ordering assembly; and a fold line formed in said combination device, said fold line extending at least substantially laterally across said combination device and located intermediate said distention and said preprinted ordering assembly whereby said front surface having the article contained within said distention is folded over rearwardly with respect to said preprinted ordering assembly such that said back face is folded inwardly wherein said distension faces inwardly, of said combination device and said front surface having said retaining member enclosing the preprinted ordering assembly faces outwardly of said folded combination device.

17. A combination sample dispensing and ordering device comprising:

a backing member having a front face and a back face;

a retaining member attached to the front face of the backing member, which retaining member defines a broad surface along a portion thereof and a distention affixed to the front face of the backing member to contain an article, a preprinted ordering assembly contained within said combination device comprising an order form disposed between the backing member and the retaining member, a portion of said retaining member proximate to said distention being affixed to said front face to prevent inadvertent release of said article from said distention, said backing member being hinged across said board surface to permit said retaining member to be lifted to access the ordering assembly; and a fold line formed in said combination device, said fold line extending at least substantially laterally across said combination device and located intermediate said distention and said preprinted ordering assembly whereby said front surface having the article contained within said distention is folded over rearwardly with respect to said preprinted ordering assembly such that said back face is folded inwardly wherein said distension faces inwardly of said combination device and said front surface having said retaining member enclosing the preprinted ordering assembly faces outwardly of said folded combination device.

* * * * *